US005209839A

United States Patent [19]

Shaub et al.

[11] Patent Number: 5,209,839

[45] Date of Patent: * May 11, 1993

[54] METHOD OF REMOVING HYDROPEROXIDES FROM LUBRICATING OILS USING SODIUM HYDROXIDE AND A METAL THIOPHOSPHATE

[75] Inventors: Harold Shaub, Berkeley Heights; Darrell W. Brownawell, Scotch Plains; Arthur DiBenedetto, Rahway, all of N.J.

[73] Assignee: Exxon Research and Engineering Co., Florham Park, N.J.

[ * ] Notice: The portion of the term of this patent subsequent to Mar. 5, 2008 has been disclaimed.

[21] Appl. No.: 846,368

[22] Filed: Mar. 5, 1992

Related U.S. Application Data

[63] Continuation-in-part of Ser. No. 619,570, Nov. 29, 1990, Pat. No. 5,112,482, which is a continuation of Ser. No. 404,250, Sep. 7, 1989, Pat. No. 4,997,546.

[51] Int. Cl.[5] ..... C10M 175/02

[52] U.S. Cl. ..... 208/183; 208/181; 208/182

[58] Field of Search ..... 208/181, 182, 183

[56] References Cited

U.S. PATENT DOCUMENTS 4,997,546 3/1991 Shaub et al. ..... 208/183

OTHER PUBLICATIONS

Habeeb, J. J. and Stover, W. H., "The Role of Hydroperoxides in Engine Wear and the Effect of Zinc Dialkyldithio Phosphates", Asle Transactions, vol. 30, 4, pp. 419–426, 1987.

*Primary Examiner*—Theodore Morris
*Assistant Examiner*—Walter D. Griffin
*Attorney, Agent, or Firm*—J. W. Ditsler

[57] ABSTRACT

NaOH can be used to remove hydroperoxides from a lubricating oil provided the oil contains a metal thiophosphate. This extends the useful life of the oil and the equipment being lubricated. In a preferred embodiment, the NaOH is immobilized within the lubrication system of an internal combustion engine.

14 Claims, 3 Drawing Sheets

METHOD OF REMOVING HYDROPEROXIDES FROM LUBRICATING OILS USING SODIUM HYDROXIDE AND A METAL THIOPHOSPHATE

This application is a continuation-in-part of U.S. Ser. No. 619,570, filed Nov. 29, 1990, now U.S. Pat. No. 5,112,482 which is a rule 60 continuation of U.S. Ser. No. 404,250, filed Sep. 7, 1989, now U.S. Pat. No. 4,997,546.

BACKGROUND OF THE INVENTION

1. Field of the Invention

This invention concerns the use of sodium hydroxide to remove hydroperoxides from a lubricating oil.

2. Description of Related Art

Hydroperoxides are known to be a source of free radicals which cause oxidative degradation of hydrocarbon oils (see M. D. Johnson et al. SAE Paper No. 831684, November 1983). Hydroperoxides have also been shown to promote valve train wear in automotive engines (see SAE Paper Nos. 872156 and 872157 as well as J. J. Habeeb et al. "The Role of Hydroperoxides in Engine Wear and the Effect of Zinc Dialkyldithiophosphates", ASLE Transactions, Vol. 30, 4, p. 419–426). Furthermore, zinc dialkyldithiophosphate (ZDDP), which has been used as an antiwear agent in lubricating oils for several years, has also been found to decompose hydroperoxides (see ASLE Transactions, supra.). However, the ZDDP in the oil will become depleted such that the oil must be periodically replaced.

As such, in view of the deleterious effects resulting from the presence of hydroperoxides in lubricating oil, it would be desirable to have available a simple, yet convenient, method of decomposing hydroperoxides while extending the useful life of the oil before it must be replaced. One such method is described in U.S. Pat. No. 4,997,546 wherein hydroperoxides are contacted with a heterogenous hydroperoxide decomposer that is immobilized when contacting the oil so as not to pass into the oil. However, the method disclosed in U.S. Pat. No. 4,997,546 requires modification when the hydroperoxide decomposer is sodium hydroxide.

SUMMARY OF THE INVENTION

This invention concerns a method for removing hydroperoxides from a lubricating oil using sodium hydroxide (NaOH). More specifically, we have discovered that when the hydroperoxide decomposer is heterogenous NaOH, hydroperoxides can be effectively removed from used lubricating oil provided the oil also contains a metal thiophosphate. By "heterogenous" is meant that the NaOH is in a separate phase (or substantially in a separate phase) from the lubricating oil; i.e. the NaOH is insoluble or substantially insoluble in the oil. The NaOH should be immobilized in some manner when contacting the oil (e.g. in crystalline form or incorporated on a substrate) to avoid solids passing into the oil. In a preferred embodiment, hydroperoxides are removed from lubricating oil circulating within the lubrication system of an internal combustion engine by contacting the oil with crystalline NaOH immobilized within the lubrication system. Most preferably, NaOH is immobilized in the oil filter of the engine.

DETAILED DESCRIPTION OF THE INVENTION

Figure 1:
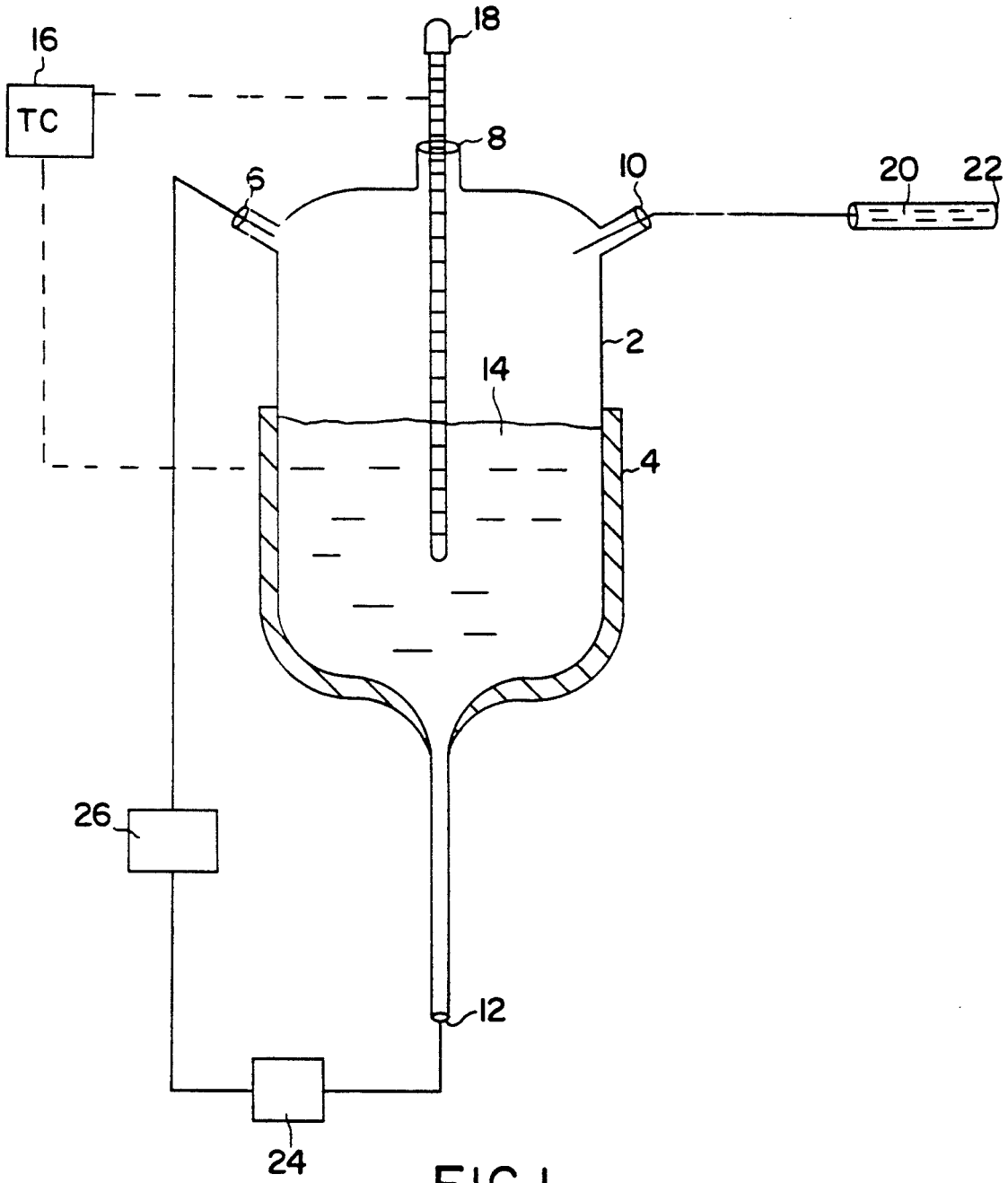
FIG. 1 shows a schematic flow diagram of the laboratory apparatus used to obtain the data in FIGS. 2 and 3.

This invention requires a lubricating base oil, sodium hydroxide, and a metal thiophosphate.

Hydroperoxides are produced when hydrocarbons in the lubricating oil contact the peroxides formed during the fuel combustion process. As such, hydroperoxides will be present in essentially any lubricating oil used in the lubrication system of essentially any internal combustion engine, including automobile and truck engines, two-cycle engines, aviation piston engines, marine and railroad engines, gas-fired engines, alcohol (e.g. methanol) powered engines, stationary powered engines, turbines, and the like. In general, the lubricating oil will comprise a major amount of lubricating oil basestock (or lubricating base oil), which can be derived from a wide variety of natural lubricating oils, synthetic lubricating oils, or mixtures thereof. Typically, the lubricating oil basestock will have a viscosity in the range of about 5 to about 10,000 cSt at 40° C., although typical applications will require an oil having a viscosity ranging from about 10 to about 1,000 cSt at 40° C.

Natural lubricating oils include animal oils, vegetable oils (e.g., castor oil and lard oil), petroleum oils, mineral oils, and oils derived from coal or shale.

Synthetic oils include hydrocarbon oils and halo-substituted hydrocarbon oils such as polymerized and interpolymerized olefins (e.g. polybutylenes, polypropylenes, propylene-isobutylene copolymers, chlorinated polybutylenes, poly(1-hexenes), poly(1-octenes), poly(1-decenes), etc., and mixtures thereof); alkylbenzenes (e.g. dodecylbenzenes, tetradecylbenzenes, dinonylbenzenes, di(2-ethylhexyl)benzene, etc.); polyphenyls (e.g. biphenyls, terphenyls, alkylated polyphenyls, etc.); alkylated diphenyl ethers, alkylated diphenyl sulfides, as well as their derivatives, analogs, and homologs thereof; and the like.

Synthetic lubricating oils also include alkylene oxide polymers, interpolymers, copolymers and derivatives thereof wherein the terminal hydroxyl groups have been modified by esterification, etherification, etc. This class of synthetic oils is exemplified by polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1,000, diphenyl ether of polyethylene glycol having a molecular weight of 500–1,000, diethyl ether of polypropylene glycol having a molecular weight of 1,000–1,500); and mono- and polycarboxylic esters thereof (e.g., the acetic acid esters, mixed $C_3$–$C_8$ fatty acid esters, and $C_{13}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid, and the like.

Esters useful as synthetic oils also include those made from $C_5$ to $C_{12}$ monocarboxylic acids and polyols and polyol ethers such as neopentyl glycol, trimethylolpropane, pentaerythritol, dipentaerythritol, tripentaerythritol, and the like. Synthetic hydrocarbon oils are also obtained from hydrogenated oligomers of normal olefins.

Silicon-based oils (such as the polyakyl-, polyaryl-, polyalkoxy-, or polyaryloxy-siloxane oils and silicate oils) comprise another useful class of synthetic lubricating oils. These oils include tetraethyl silicate, tetraisopropyl silicate, tetra-(2-ethylhexyl) silicate, tetra-(4-methyl-2-ethylhexyl) silicate, tetra(p-tert-butylphenyl) silicate, hexa-(4-methyl-2-pentoxy)-disiloxane, poly(methyl)-siloxanes and poly(methylphenyl) siloxanes, and the like. Other synthetic lubricating oils include liquid esters of phosphorus-containing acids (e.g., tricresyl phosphate, trioctyl phosphate, diethyl ester of decylphosphonic acid), polymeric tetrahydrofurans, polyalphaolefins, and the like.

The lubricating oil may be derived from unrefined, refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating refined oils in processes similar to those used to obtain the refined oils. These rerefined oils are also known as reclaimed or reprocessed oils and often are additionally processed by techniques for removal of spent additives and oil breakdown products.

The precise amount of NaOH used can vary broadly, depending upon the amount of hydroperoxide present in the lubricating oil. However, although only an amount effective (or sufficient) to reduce the hydroperoxide content of the lubricating oil need be used, the amount of NaOH will typically range from about 0.05 to about 2.0 wt. %, although greater amounts could be used. Preferably, from about 0.01 to about 1.0 wt. % (based on weight of the lubricating oil) of the NaOH will be used.

The NaOH should be immobilized in some manner when contacting the oil. For example, it could be immobilized on a substrate. However, a substrate would not be required if the NaOH were in crystalline form. If a substrate were used, the substrate may (or may not) be within the lubrication system of an engine. Preferably, however, the substrate will be located within the lubrication system (e.g., on the engine block or near the sump). More preferably, the substrate will be part of the filter system for filtering the engine's lubricating oil, although it could be separate therefrom. Suitable substrates include, but are not limited to, alumina, activated clay, cellulose, cement binder, silica-alumina, and activated carbon. Alumina, cement binder, and activated carbon are preferred substrates, with activated carbon being particularly preferred. The substrate may (but need not) be inert and can be formed into various shapes such as pellets or spheres.

The NaOH may be incorporated on or with the substrate by methods known to those skilled in the art. For example, if the substrate were activated carbon, the NaOH can be deposited by using the following technique. The NaOH is dissolved in a volatile solvent. The carbon is then saturated with the NaOH-containing solution and the solvent evaporated, leaving the NaOH on the carbon substrate.

The metal thiophosphates used in this invention preferably comprises a metal selected from the group consisting of Group IB, IIB, VIB, VIII of the Periodic Table, and mixtures thereof. A metal dithiophosphate is a preferred metal thiophosphate, with a metal dialkyldithiophosphate being particularly preferred. Copper, nickel, and zinc are particularly preferred metals, with zinc being most preferred. The alkyl groups preferably comprise from 3 to 10 carbon atoms. Particularly preferred metal thiophosphates are zinc dialkyldithiophosphates.

The amount of metal thiophosphate used in this invention can range broadly. Typically, however, the concentration of the metal thiophosphate will range from about 0.1 to about 2 wt. %, preferably from about 0.3 to about 1 wt. %, of the lubricating oil.

NaOH and metal thiophosphates are commercially available from a number of vendors. As such, their methods of manufacture are well known to those skilled in the art.

The lubricating base oil may also contain additional additives so as to form a fully formulated lubricating oil. Such additives include dispersants, antiwear agents, antioxidants, corrosion inhibitors, detergents, pour point depressants, extreme pressure additives, viscosity index improvers, friction modifiers, and the like. These additives are typically disclosed, for example, in "Lubricant Additives" by C. V. Smalheer and R. Kennedy Smith, 1967, pp. 1-11 and in U.S. Pat. No. 4,105,571, the disclosures of which are incorporated herein by reference. Normally, there is from about 1 to about 20 wt. % of these additives in a fully formulated lubricating oil. However, the precise additives used (and their relative amounts) will depend upon the particular application of the oil.

This invention can also be combined with the removal of carcinogenic components from a lubricating oil, as is disclosed in U.S. Pat. No. 4,977,871, the disclosure of which is incorporated herein by reference. For example, polynuclear aromatic hydrocarbons (especially PNA's with at least three aromatic rings, preferably from four to six aromatic rings) that are usually present in used lubricating oil can be removed (i.e., reduced by from about 60 to about 90% or more) by passing the oil through a sorbent. If desired, the sorbent may be immobilized with the NaOH. Preferably, the NaOH and sorbent will be located within the lubrication system of an internal combustion engine through which the oil must circulate after being used to lubricate the engine. Most preferably, the NaOH and sorbent will be part of the engine filter system for filtering oil. If the latter, the sorbent can be conveniently located on the engine block or near the sump, preferably downstream of the oil as it circulates through the engine (i.e., after the oil has been heated). Most preferably, the sorbent is downstream of the NaOH.

Suitable sorbents include activated carbon, attapulgus clay, silica gel, molecular sieves, dolomite clay, alumina, zeolite, or mixtures thereof. Activated carbon is preferred because (1) it is at least partially selective to the removal of polynuclear aromatics containing more than 3 aromatic rings, (2) the PNA's removed are tightly bound to the carbon and will not be leached-out to become free PNA's after disposal, (3) the PNA's removed will not be redissolved in the used lubricating oil, and (4) heavy metals such as lead and chromium will be removed as well. Although most activated carbons will remove PNA's to some extent, wood and peat based carbons are significantly more effective in removing four and higher ring aromatics than coal or coconut based carbons.

The amount of sorbent required will depend upon the PNA concentration in the lubricating oil. Typically, for five quarts of oil, about 20 to about 150 grams of activated carbon can reduce the PNA content of the use lubricating oil by up to 90%. Used lubricating oils usually contain from about 10 to about 10,000 ppm of PNA's.

It may be necessary to provide a container to hold the sorbent, such as a circular mass of sorbent supported on wire gauze. Alternatively, an oil filter could comprise the sorbent capable of combining with polynuclear aromatic hydrocarbons held in pockets of filter paper.

Any of the foregoing embodiments of this invention can also be combined with a sorbent (such as those described above) that is mixed, coated, or impregnated with additives normally present in lubricating oils, particularly engine lubricating oils (see U.S. Pat. No. 4,977,871). In this embodiment, additives (such as the lubricating oil additives described above) are slowly released into the lubricating oil to replenish the additives as they are depleted during operation of the engine. The ease with which the additives are released into the oil depends upon the nature of the additive and the sorbent. Preferably, however, the additives will be totally released within 150 hours of engine operation. In addition, the sorbent may contain from about 50 to about 100 wt. % of the additive (based on the weight of activated carbon), which generally corresponds to 0.5 to 1.0 wt. % of the additive in the lubricating oil.

Any of the foregoing embodiments may also be combined with a method for reducing piston deposits resulting from neutralizing fuel combustion acids in the piston ring zone (i.e., that area of the piston liner traversed by the reciprocating piston) of an internal combustion engine (see U.S. Pat. No. 4,906,389, the disclosure of which is incorporated herein by reference. More specifically, these deposits can be reduced or eliminated from the engine by contacting the combustion acids at the piston ring zone with a soluble weak base for a period of time sufficient to neutralize a major portion (preferably essentially all) of the combustion acids and form soluble neutral salts which contain a weak base and a strong combustion acid.

This embodiment requires that a weak base be present in the lubricating oil. The weak base will normally be added to the lubricating oil during its formulation or manufacture. Broadly speaking, the weak bases can be basic organophosphorus compounds, basic organonitrogen compounds, or mixtures thereof, with basic organonitrogen compounds being preferred. Families of basic organophosphorus and organonitrogen compounds include aromatic compounds, aliphatic compounds, cycloaliphatic compounds, or mixtures thereof. Examples of basic organonitrogen compounds include, but are not limited to, pyridines; anilines; piperazines; morpholines; alkyl, dialkyl, and trialky amines; alkyl polyamines; and alkyl and aryl guanidines. Alkyl, dialkyl, and trialkyl phosphines are examples of basic organophosphorus compounds.

Examples of particularly effective weak bases are the dialkyl amines ($R_2HN$), trialkyl amines ($R_3N$), dialkyl phosphines ($R_2HP$), and trialkyl phosphines ($R_3P$), where R is an alkyl group, H is hydrogen, N is nitrogen, and P is phosphorus. All of the alkyl groups in the amine or phosphine need not have the same chain length. The alkyl group should be substantially saturated and from 1 to 22 carbons in length. For the di- and tri- alkyl phosphines and the di- and trialkyl amines, the total number of carbon atoms in the alkyl groups should be from 12 to 66. Preferably, the individual alkyl group will be from 6 to 18, more preferably from 10 to 18, carbon atoms in length.

Trialkyl amines and trialkyl phosphines are preferred over the dialkyl amines and dialkyl phosphines. Examples of suitable dialkyl and trialkyl amines (or phosphines) include tributyl amine (or phosphine), dihexyl amine (or phosphine), decylethyl amine (or phosphine), trihexyl amine (or phosphine), trioctyl amine (or phosphine), trioctyldecyl amine (or phosphine), tridecyl amine (or phosphine), dioctyl amine (or phosphine), trieicosyl amine (or phosphine), tridocosyl amine (or phosphine), or mixtures thereof. Preferred trialkyl amines are trihexyl amine, trioctadecyl amine, or mixtures thereof, with trioctadecyl amine being particularly preferred. Preferred trialkyl phosphines are trihexyl phosphine, trioctyldecyl phosphine, or mixtures thereof, with trioctadecyl phosphine being particularly preferred. Still another example of a suitable weak base is the polyethyleneamine imide of polybutenylsuccinic anhydride with more than 40 carbons in the polybutenyl group.

The weak base must be strong enough to neutralize the combustion acids (i.e., form a salt). Suitable weak bases will typically have a PKa from about 4 to about 12. However, even strong organic bases (such as organoguanidines) can be utilized as the weak base if the strong base is an appropriate oxide or hydroxide and is capable of releasing the weak base from the weak base/-combustion acid salt.

The molecular weight of the weak base should be such that the protonated nitrogen compound retains its oil solubility. Thus, the weak base should have sufficient solubility so that the salt formed remains soluble in the oil and does not precipitate. Adding alkyl groups to the weak base is the preferred method to ensure its solubility.

The amount of weak base in the lubricating oil for contact at the piston ring zone will vary depending upon the amount of combustion acids present, the degree of neutralization desired, and the specific applications of the oil. In general, the amount need only be that which is effective or sufficient to neutralize at least a portion of the combustion acids present at the piston ring zone. Typically, the amount will range from about 0.01 to about 3 wt. % or more, preferably from about 0.1 to about 1.0 wt. %.

Following neutralization of the combustion acids, the neutral salts are passed or circulated from the piston ring zone with the lubricating oil and contacted with a heterogenous strong base. By strong base is meant a base that will displace the weak base from the neutral salts and return the weak base to the oil for recirculation to the piston ring zone where the weak base is reused to neutralize combustion acids. Examples of suitable strong bases include, but are not limited to, barium oxide (BaO), calcium carbonate ($CaCO_3$), calcium oxide (CaO), calcium hydroxide ($Ca(OH)_2$) magnesium carbonate ($MgCO_3$), magnesium hydroxide ($Mg(OH)_2$), magnesium oxide (MgO), sodium aluminate ($NaAlO_2$), sodium carbonate ($Na_2CO_3$), sodium hydroxide (NaOH), zinc oxide (ZnO), or their mixtures, with MgO being particularly preferred. By "heterogenous strong base" is meant that the strong base is in a separate phase (or substantially in a separate phase) from the lubricating oil, i.e., the strong base is insoluble or substantially insoluble in the oil.

The strong base may be incorporated (e.g. impregnated) on or with a substrate immobilized in the lubricating system of the engine, but subsequent to (or downstream of) the piston ring zone. Thus, the substrate can be located on the engine block or near the sump. Preferably, the substrate will be part of the filter system for filtering oil, although it could be separate therefrom. Suitable substrates include, but are not limited to, alumina, activated clay, cellulose, cement binder, silica-alumina, and activated carbon. The alumina, cement binder, and activated carbon are preferred, with cement binder being particularly preferred. The substrate may (but need not) be inert.

The amount of strong base required will vary with the amount of weak base in the oil and the amount of combustion acids formed during engine operation. However, since the strong base is not being continuously regenerated for reuse as is the weak base (i.e., the alkyl amine), the amount of strong base must be at least equal to (and preferably be a multiple of) the equivalent weight of the weak base in the oil. Therefore, the amount of strong base should be from 1 to about 15 times, preferably from 1 to about 5 times, the equivalent weight of the weak base in the oil.

Once the weak base has been displaced from the soluble neutral salts, the strong base/strong combustion acid salts thus formed will be immobilized as heterogenous deposits with the strong base or with the strong base on a substrate if one is used. Thus, deposits which would normally be formed in the piston ring zone are not formed until the soluble salts contact the strong base. Preferably, the strong base will be located such that it can be easily removed from the lubrication system e.g., included as part of the oil filter system).

Thus, this invention can be combined with removing PNA's from a lubricating oil, enhancing the performance of a lubricating oil by releasing conventional additives into the oil, reducing piston deposits in an internal combustion engine, or a combination thereof.

Although this invention has heretofore been described with specific reference to using NaOH to remove hydroperoxides from lubricating oils used in internal combustion engines, it can also be suitably applied to essentially any oil (e.g. industrial lubricating oils) containing hydroperoxides.

This invention may be further understood by reference to the following examples which are not intended to restrict the scope of the appended claims. In these examples, the oxidative stability of the oils tested was determined by measuring the millimoles of hydroperoxides in the oil according to the following steps:

1. Add 2 grams of the sample to a 250 ml volumetric flask containing a 3:2 acetic acid:chloroform mixture.
2. Add 2 ml of a saturated aqueous potassium iodide solution (see below for preparation) to the mixture in step 1.
3. Flush the flask containing the mixture from step 2 with $N_2$ gas, cap the flask, and then let it stand at room temperature for about 15 minutes.
4. Add 50 ml of distilled water and 4 drops of starch indicator solution (see below for preparation). The resulting mixture has a blue color.
5. Titrate the mixture in step 4 with 0.1 N sodium thiosulfate ($Na_2S_2O_3$) solution until the mixture becomes colorless.
6. Repeat steps 1–5 without the 2 grams of sample to determine the volume of 0.1 N $Na_2S_2O_3$ for a blank.
7. Calculate the millimoles of hydroperoxide as follows:

$$\frac{\text{mmoles ROOH}}{\text{Kg sample}} = \frac{[A - B]N}{2W} \quad (1)$$

where:

A = Volume of 0.1 N $Na_2S_2O_3$ to titrate 2 gram sample (procedure, step 5).

B = Volume of 0.1 N $Na_2S_2O_3$ for blank determination (procedure, step 6).

N = Normality of $Na_2S_2O_3$

W = Weight of the sample in kilograms.

The starch indicator solution is prepared as follows:

a. Make a paste of 4 grams of starch and 50 grams of distilled and de-ionized water.
b. Add this paste, with stirring, to 500 mls of boiling distilled and de-ionized water.
c. Heat, with stirring, for approximately 15 minutes.
d. Add 2 grams of boric acid as a preservative.

The saturated aqueous potassium iodide solution is prepared as follows:

a. Add 1 gram potassium iodide to 1.3 ml $H_2O$.
b. A 100 ml solution is made by adding 77 grams of potassium iodide to a 100 ml volumetric flask, with distilled water then being added to reach 100 ml volume.

Lower amounts of hydroperoxide represent greater oxidative stability.

EXAMPLE 1—HYDROPEROXIDE DECOMPOSITION IN A ZDDP CONTAINING OIL

FIG. 1 is a schematic flow diagram of the apparatus used to measure the decomposition of hydroperoxides. The apparatus includes a 250 ml glass flask 2 that is partially surrounded by a heating mantle 4. The flask has four openings shown at locations 6, 8, 10, and 12, and contains 150 grams of oil 14. The temperature of oil 14 is maintained at about 70° C. using a temperature controller 16, which is connected to a thermometer 18 that extends into oil 14 through opening 8. Controller 16 is also connected to heating mantle 4. A three molar solution 20 of t-butyl-hydroperoxide in octane is added continuously (and automatically) to flask 2 through opening 10 at a rate of 5 cc/hr. over five hours. Solution 20 is added from a glass syringe 22 that contains 100 ml of the solution. Hydroperoxide containing oil is then circulated from flask 2 through opening 12 by pump 24 through a filter 26 into flask 2 through opening 6. In some runs, a hydroperoxide decomposer is present in filter 26; in other runs, no hydroperoxide decomposer is present. The hydroperoxide decomposer is either crystalline NaOH or crystalline $MoO_2$ (n-Bu-DTC)$_2$ where Bu is butyl and DTC is dithiocarbamate. Samples of the hydroperoxide containing oil were taken periodically and the millimoles of hydroperoxide in 150 grams of oil were calculated using equation (1) above.

The results of these tests using a 10W30 commercially available automotive engine oil containing 1 wt. % ZDDP are shown in Table 1 below and in FIG. 2.

TABLE 1

| Oil: 10W30 automotive engine oil with 1.0 wt. % ZDDP | | | |
|---|---|---|---|
| Hydroperoxide Decomposer in Filter | Sample Time hr | m moles HP Added to Oil | m moles HP in 150 g Oil |
| None | 0.5 | 15.0 | 0.2 |
| | 1.0 | 22.5 | 2.8 |
| | 2.5 | 30.0 | 6.1 |
| | 2.0 | 37.5 | 12.3 |
| | 2.5 | 45.0 | 16.9 |
| | 3.0 | 52.5 | 22.9 |
| | 3.5 | 60.0 | 28.3 |
| | 4.0 | 67.5 | 37.0 |
| | 4.5 | 75.0 | 46.6 |
| | 5.0 | 82.5 | 52.0 |
| NaOH | 0.5 | 7.5 | 0.4 |
| | 1.0 | 15.0 | 0.6 |
| | 1.5 | 22.5 | 1.8 |
| | 2.0 | 30.0 | 3.3 |
| | 2.5 | 37.5 | 5.7 |
| | 3.0 | 45.0 | 10.4 |
| | 3.5 | 52.5 | 12.7 |
| | 4.0 | 60.0 | 15.4 |
| | 4.5 | 67.5 | 15.6 |
| | 5.0 | 75.0 | 19.2 |
| $MoO_2$ (n-Bu-DTC)$_2$ | 0.5 | 15.0 | 0.9 |
| | 1.0 | 22.5 | 1.9 |
| | 1.5 | 30.0 | 3.4 |
| | 2.0 | 37.5 | 5.1 |
| | 2.5 | 45.0 | 5.6 |
| | 3.0 | 52.5 | 7.5 |
| | 3.5 | 60.0 | 10.4 |
| | 4.0 | 67.5 | 14.4 |
| | 4.5 | 75.0 | 16.9 |
| | 5.0 | 82.5 | 18.8 |

Figure 2:
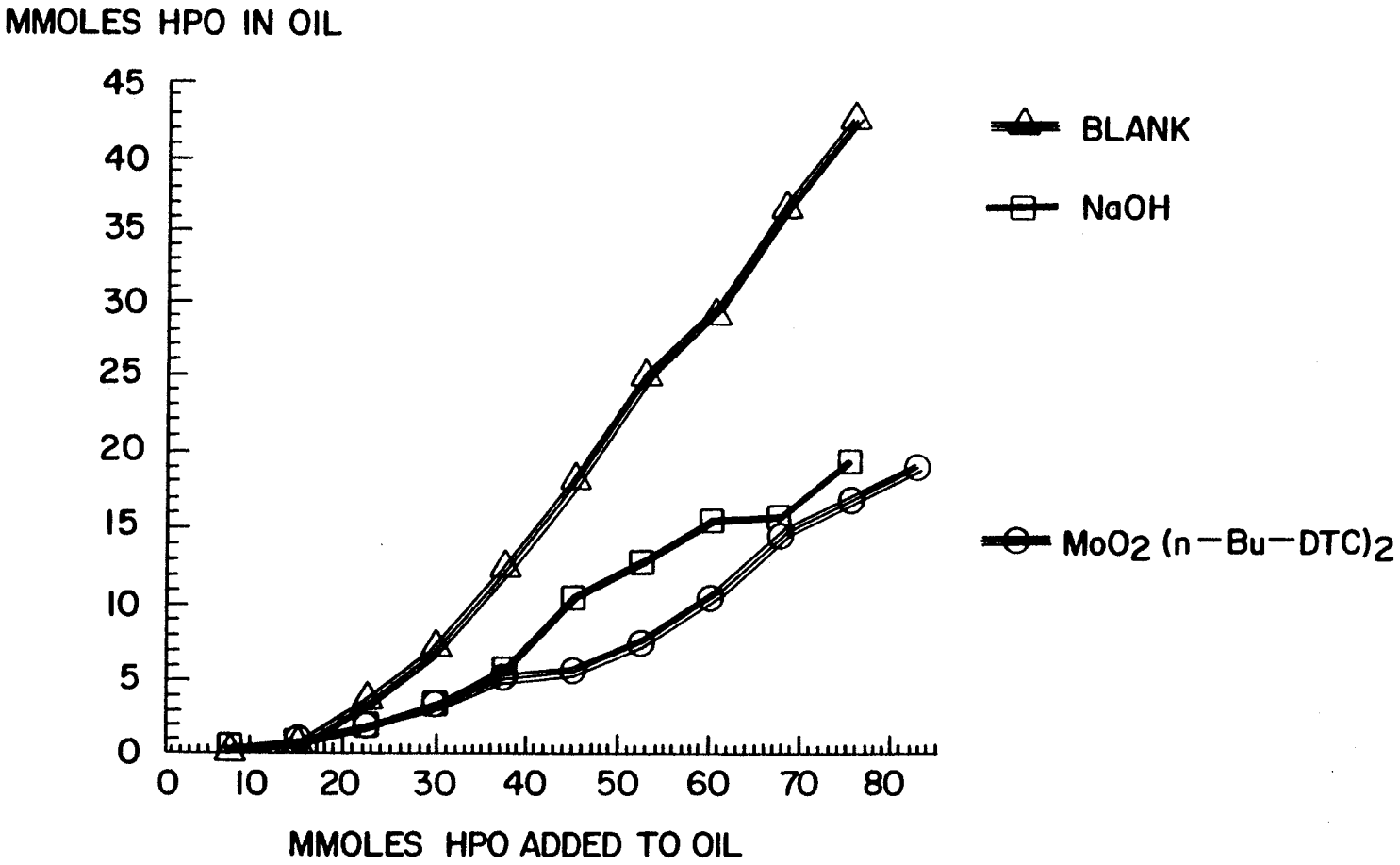
FIG. 2 shows the decomposition of hydroperoxides in a commercially available, fully formulated lubricating oil containing zinc dialkyldithiophosphate.

FIG. 2 shows that in an oil containing zinc dialkyldithiophosphate, NaOH and $MoO_2$ (n-bu-DTC)$_2$ are comparable hydroperoxide decomposers.

EXAMPLE 2—HYDROPEROXIDE DECOMPOSITION IN SOLVENT NEUTRAL 150

Example 1 was repeated using solvent 150 neutral. The results of these tests are shown in Table 2 below and in FIG. 3.

TABLE 2

| Oil: Solvent 150 Neutral | | | |
|---|---|---|---|
| Hydroperoxide Decomposer in Filter | Sample Time hr | m moles HP Added to Oil | m moles HP in 150 g Oil |
| None | 0.5 | 7.5 | 5.7 |
| | 1.0 | 15.0 | 10.0 |
| | 1.5 | 22.5 | 14.5 |
| | 2.0 | 30.0 | 20.3 |
| | 2.5 | 37.5 | 24.8 |
| | 3.0 | 45.0 | 30.3 |
| | 3.5 | 52.5 | 36.4 |
| | 4.0 | 60.0 | 42.1 |
| | 4.5 | 67.5 | 48.4 |

TABLE 2-continued

| Oil: Solvent 150 Neutral | | | |
|---|---|---|---|
| Hydroperoxide Decomposer in Filter | Sample Time hr | m moles HP Added to Oil | m moles HP in 150 g Oil |
| | 5.0 | 75.0 | 53.6 |
| NaOH | 0.5 | 7.5 | 8.9 |
| | 1.0 | 15.0 | 12.3 |
| | 1.5 | 22.5 | 19.3 |
| | 2.0 | 30.0 | 25.3 |
| | 2.5 | 37.5 | 32.6 |
| | 3.0 | 45.0 | 35.2 |
| | 3.5 | 52.5 | 42.4 |
| | 4.0 | 60.0 | 48.3 |
| | 4.5 | 67.5 | 53.4 |
| | 5.0 | 75.0 | 55.7 |
| $MoO_2$ (n-Bu-DTC)$_2$ | 0.25 | 3.0 | 0.2 |
| | 0.5 | 7.5 | 0.5 |
| | 0.75 | 12.0 | 0.8 |
| | 1.0 | 15.0 | 0.9 |
| | 1.25 | 18.0 | 1.5 |
| | 1.75 | 21.0 | 2.2 |
| | 2.0 | 25.5 | 2.6 |
| | 2.25 | 28.5 | 3.8 |
| | 2.75 | 36.0 | 5.1 |
| | 3.25 | 42.0 | 6.6 |
| | 3.75 | 48.0 | 7.5 |
| | 4.0 | 54.0 | 8.9 |
| | 5.5 | 75.0 | 13.9 |

Figure 3:
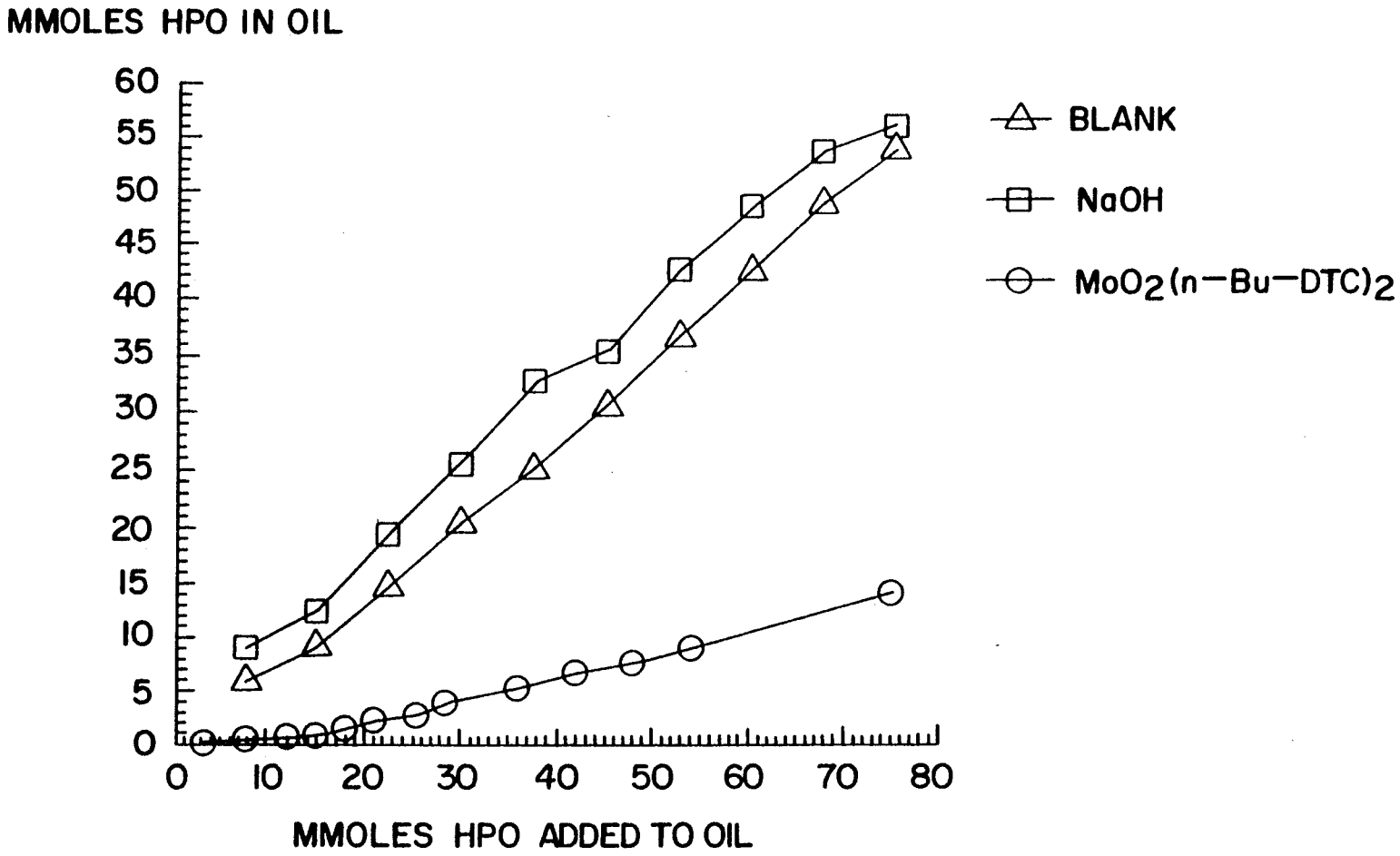
FIG. 3 shows the decomposition of hydroperoxides in solvent 150 neutral without any additives.

FIG. 3 shows that NaOH is not effective in decomposing hydroperoxides in solvent 150 neutral in which no additives are present.

What is claimed is:

1. In a method of decomposing hydroperoxides present in a lubricating oil which comprises contacting the lubricating oil with a heterogenous hydroperoxide decomposer for a period of time sufficient to cause a reduction in the amount of hydroperoxides present in the oil, the hydroperoxide decomposer being immobilized when contacting the oil so as not to pass into the oil, the improvement which comprises adding a metal thiophosphate to the oil when the hydroperoxide decomposer is NaOH to obtain the reduction in hydroperoxides.

2. The method of claim 1 wherein the amount of hydroperoxide decomposer ranges from about 0.05 to about 2.0 wt. %.

3. The method of claim 2 wherein the hydroperoxide decomposer is immobilized on a substrate.

4. The method of claim 3 wherein the substrate is alumina, activated clay, cellulose, cement binder, silica-alumina, activated carbon, or mixtures thereof.

5. The method of claim 4 wherein the substrate comprises activated carbon.

6. The method of claim 1 wherein the lubricating oil is circulating within the lubrication system of an internal combustion engine and the NaOH is immobilized within the lubrication system.

7. The method of claim 6 wherein the NaOH is included within an engine oil filter located within the lubrication system.

8. The method of claim 7 wherein polynuclear aromatic compounds are present in the lubricating oil and are removed therefrom by contacting the oil with a sorbent located within the lubrication system.

9. The method of claim 8 wherein the sorbent is impregnated with at least one engine lubricating oil additive.

10. The method of claim 7 wherein a weak base is present in the lubricating oil and a heterogenous strong base is present in the engine oil filter such that soluble neutral salts formed by contacting the weak base with combustion acids present in the piston ring zone of an internal combustion engine are circulated to the filter and contacted with the strong base, thereby displacing a portion of the weak base from the salt into the lubricating oil, which results in the formation of a strong base/combustion acid salt immobilized with the strong base.

11. The method of claim 1 wherein said metal thiophosphate is selected from the group consisting of Group IB, IIB, VIB, VIII of the periodic Table, and mixtures thereof.

12. The method of claim 11 wherein said metal thiophosphate is a dilkyldithiophosphate.

13. The method of claim 1 wherein the metal component of said metal thiophosphate is copper, nickel, or zinc.

14. The method of claim 13 wherein the metal component is zinc.

* * * * *